US010988880B1

(12) United States Patent
Mikolajewski et al.

(10) Patent No.: US 10,988,880 B1
(45) Date of Patent: Apr. 27, 2021

(54) MATERIAL ALIGNER

(71) Applicant: SoftWear Automation Inc., Cumming, GA (US)

(72) Inventors: David Otto Konrad Mikolajewski, Atlanta, GA (US); Luther Lloyd, III, Powder Springs, GA (US); Michael J. Baker, Acworth, GA (US)

(73) Assignee: SoftWear Automation, Inc., Cumming, GA (US)

( * ) Notice: Subject to any disclaimer, the term of this patent is extended or adjusted under 35 U.S.C. 154(b) by 0 days.

(21) Appl. No.: 16/984,815

(22) Filed: Aug. 4, 2020

(51) Int. Cl.

| | |
|---|---|
| ***D05B 69/10*** | (2006.01) |
| ***D05B 69/02*** | (2006.01) |
| ***D05B 69/30*** | (2006.01) |
| ***D05B 27/10*** | (2006.01) |
| *D05B 27/20* | (2006.01) |
| *D05B 39/00* | (2006.01) |

(52) U.S. Cl.
CPC ..... *D05B 69/10* (2013.01); *D05B 27/10* (2013.01); *D05B 69/02* (2013.01); *D05B 69/30* (2013.01); *D05B 39/00* (2013.01)

(58) Field of Classification Search
CPC ..... D05B 69/00–36; D05B 27/10–16; D05B 39/00
See application file for complete search history.

(56) References Cited

U.S. PATENT DOCUMENTS

| | | | | | |
|---|---|---|---|---|---|
| 2,106,536 | A * | 1/1938 | Rubel | D05B 27/14 | 112/304 |
| 2,546,527 | A * | 3/1951 | Smyth | D06H 5/006 | 112/306 |
| 4,191,118 | A * | 3/1980 | Blessing | D05B 27/12 | 112/153 |
| 4,714,036 | A * | 12/1987 | Raisin | D05B 35/12 | 112/147 |
| 5,054,409 | A * | 10/1991 | Schips | D05B 35/102 | 112/153 |
| 5,568,778 | A * | 10/1996 | Sahl | D05B 27/10 | 112/306 |
| 6,250,238 | B1 * | 6/2001 | Resta | D05B 11/005 | 112/2.1 |
| 8,695,519 | B2 * | 4/2014 | Bearden | D05C 15/14 | 112/475.23 |
| 8,919,269 | B1 * | 12/2014 | Chen | D05B 35/00 | 112/304 |

* cited by examiner

*Primary Examiner* — Ismael Izaguirre
(74) *Attorney, Agent, or Firm* — Thomas | Horstemeyer, LLP

(57) ABSTRACT

Various examples are provided related to transporting and sewing material in, e.g., automation of sewing robots. An automated sewing process feed control system is disclosed in which a material aligner is utilized. An omni-chain material aligner can include a circular roller chain in which the rollers allow for a controlling force to be applied to a material. An omni-belt material aligner can include a belt with attached perpendicular rollers which allow feed control and active motorized steering control. The material aligner can control the pressure applied onto the material to facilitate control of feeding the material.

20 Claims, 9 Drawing Sheets

MATERIAL ALIGNER

BACKGROUND

Maneuvering materials throughout an automated sewing process is a difficult task due to the flexibility and elasticity of materials. Materials may become misaligned during the process, requiring operator interaction. In order to maneuver material through an automated sewing process there needs to be an apparatus that can properly align the materials through the sewing machine without restricting the materials being fed through the sewing machine to reduce or eliminate the need for operator assistance.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also correspond to implementations of the claimed technology.

BRIEF DESCRIPTION OF THE DRAWINGS

The accompanying drawings illustrate various examples of systems, methods, and embodiments of various other aspects of the disclosure. Any person with ordinary skills in the art will appreciate that the illustrated element boundaries (e.g., boxes, groups of boxes, or other shapes) in the figures represent one example of the boundaries. It may be that in some examples one element may be designed as multiple elements or that multiple elements may be designed as one element. In some examples, an element shown as an internal component of one element may be implemented as an external component in another, and vice versa. Furthermore, elements may not be drawn to scale. Non-limiting and non-exhaustive descriptions are described with reference to the following drawings. The components in the figures are not necessarily to scale, emphasis instead being placed upon illustrating principles. Moreover, in the drawings, like reference numerals designate corresponding parts throughout the several views.

DETAILED DESCRIPTION

Figure 1:
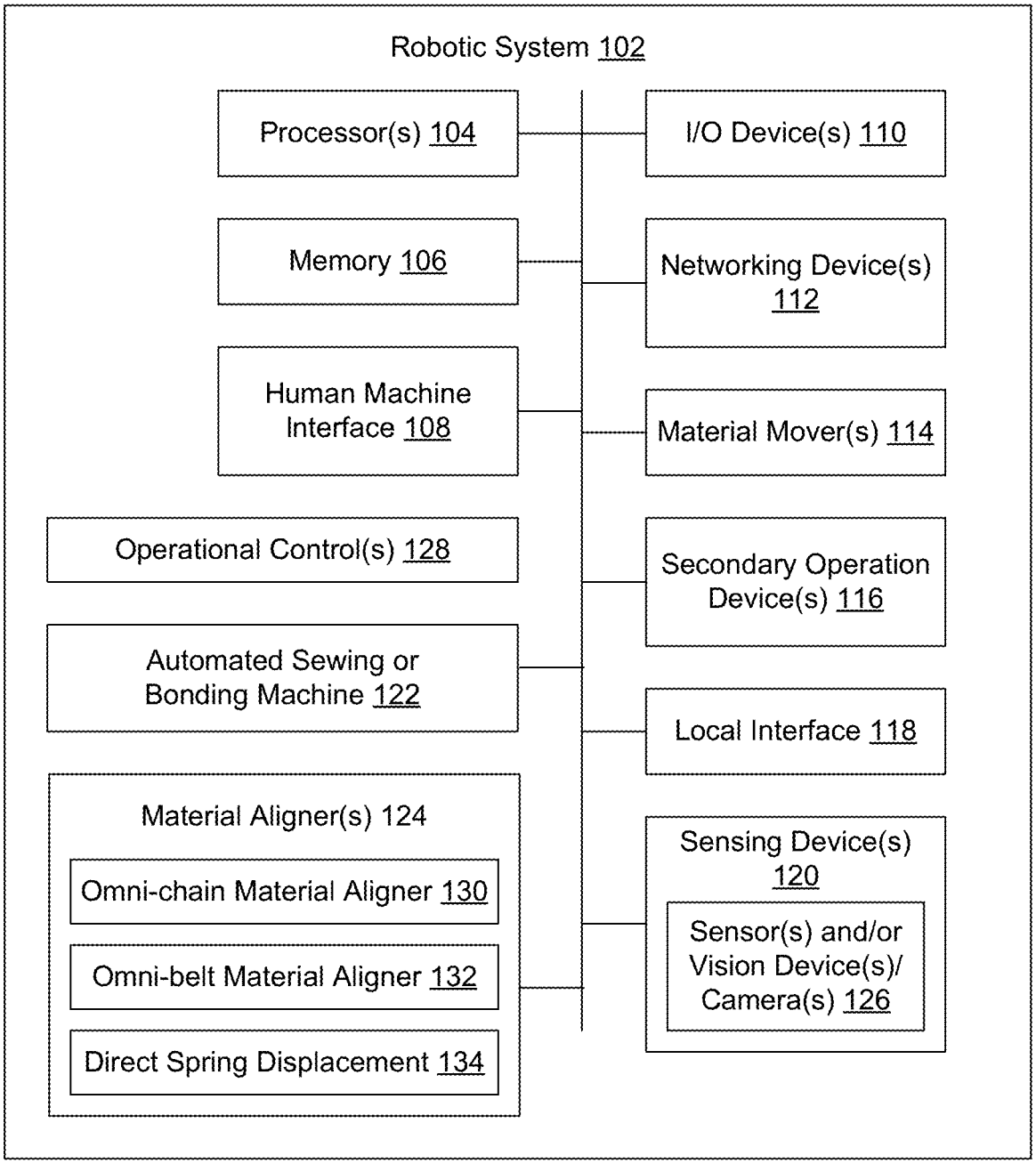
FIG. 1 illustrates an example of a robotic system, according to various embodiments of the present disclosure.

Disclosed herein are various examples related to manipulation or alignment of material for processing, e.g., in the automated production of sewn or bonded products. The present disclosure is generally related to systems, apparatuses, and methods for the manipulation or alignment of flexible or flimsy material such as, e.g., fabrics or thin films. For example, an apparatus such as a material aligner can be used in an automated sewing process feed control system for alignment of the material for processing. The material aligner can adapt to arbitrary seam shapes or edges during sewing or bonding of the material. Reference will now be made in detail to the description of the embodiments as illustrated in the drawings, wherein like reference numbers indicate like parts throughout the several views.

The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items.

It must also be noted that as used herein and in the appended claims, the singular forms "a," "an," and "the" include plural references unless the context clearly dictates otherwise. Although any systems and methods similar or equivalent to those described herein can be used in the practice or testing of embodiments of the present disclosure, the preferred systems and methods are now described.

Embodiments of the present disclosure will be described more fully hereinafter with reference to the accompanying drawings in which like numerals represent like elements throughout the several figures, and in which example embodiments are shown. Embodiments of the claims may, however, be embodied in many different forms and should not be construed as limited to the embodiments set forth herein. The examples set forth herein are non-limiting examples and are merely examples among other possible examples.

Referring to FIG. 1, shown is an example of a system that can be used for material manipulation and bonding (e.g., sewing, ultrasonic welding, thermal bonding, gluing or other bonding or joining technology). As illustrated in the example of FIG. 1, the system can comprise a robotic system 102, which can include a processor 104, memory 106, an interface such as, e.g., a human machine interface (HMI) 108, I/O device(s) 110, networking device(s) 112, material mover(s) 114, secondary operation device(s) 116, a local interface 118, sensing device(s) 120, an automated sewing or bonding machine 122, and material aligner(s) 124. The sensing device(s) 120 can comprise one or more sensor and/or vision device/camera 126. The automated sewing or bonding machine 122 includes a sewing machine with at least one sewing needle at the sewing head as will be discussed. In other embodiments, the automated sewing or bonding machine 122 can include a bonding or joining apparatus configured to bond the material together using, e.g., ultrasonic welding, thermal bonding, gluing or other bonding or joining technology appropriate for the material. The robotic system 102 can also include operational control(s) 128, which can be executed by the robotic system 102 to implement manipulation and/or processing of materials. The material aligner(s) 124 can include, but are not limited to, omni-chain material aligner(s) 130 and omni-belt material aligner(s) 132. Positioning of a material aligner 124 can be controlled by, e.g., direct spring displacement 134 or other appropriate positioning device or assembly.

The processor 104 can be configured to decode and execute any instructions received from one or more other electronic devices or servers. The processor can include one or more general-purpose processors (e.g., INTEL® or Advanced Micro Devices® (AMD) microprocessors) and/or one or more special purpose processors (e.g., digital signal processors or Xilinx® System on Chip (SOC) field programmable gate array (FPGA) processor). The processor 104 may be configured to execute one or more computer-readable program instructions, such as program instructions to carry out any of the functions described in this description.

The Memory 106 can include, but is not limited to, fixed (hard) drives, magnetic tape, floppy diskettes, optical disks, Compact Disc Read-Only Memories (CD-ROMs), and magneto-optical disks, semiconductor memories, such as ROMs, Random Access Memories (RAMs), Programmable Read-Only Memories (PROMs), Erasable PROMs (EPROMs), Electrically Erasable PROMs (EEPROMs), flash memory, magnetic or optical cards, or other type of media/machine-readable medium suitable for storing electronic instructions. The memory 106 can comprise one or more modules (e.g., operational control(s) 128) that can be implemented as a program executable by processor(s) 104.

The interface(s) or HMI 108 can accept inputs from users, provide outputs to the users or may perform both the actions. In one case, a user can interact with the interface(s) using one or more user-interactive objects and devices. The user-interactive objects and devices may comprise user input buttons, switches, knobs, levers, keys, trackballs, touchpads, cameras, microphones, motion sensors, heat sensors, inertial sensors, touch sensors, visual indications (e.g., indicator lights or meters), audio indications (e.g., bells, buzzers, etc.) or a combination of the above. Further, the interface(s) can either be implemented as a command line interface (CLI), a graphical user interface (GUI), a voice interface, or a web-based user-interface, at element 108. The interface(s) can also include combinations of physical and/or electronic interfaces, which can be designed based upon the environmental setting or application.

The input/output devices or I/O devices 110 of the robotic system 102 can comprise components used to facilitate connections of the processor 104 to other devices such as, e.g., material mover(s) 114, secondary operation device(s) 116, sensing device(s) 120 and/or the automated sewing or bonding machine 122 and can comprise one or more serial, parallel, small system interface (SCSI), universal serial bus (USB), IEEE 1394 (i.e. Firewire™) connection elements or other appropriate connection elements.

The networking device(s) 112 of the robotic system 102 can comprise the various components used to transmit and/or receive data over a network. The networking device(s) 112 can include a device that can communicate both inputs and outputs, for instance, a modulator/demodulator (i.e. modem), a radio frequency (RF) or infrared (IR) transceiver, a telephonic interface, a bridge, a router, as well as a network card, etc.

The material mover(s) 114 of the robotic system 102 can facilitate material manipulation between operations. For example, the material mover(s) 114 may move, stack, or position the materials prior to the next operation. In some embodiments, the material mover(s) 114 may transport materials into a predetermined alignment or position prior to, during or after a cutting, sewing, or other operation.

The secondary operation device(s) 116 can include destacking device(s), stacking device(s), folding device(s), label manipulation device(s), and/or other device(s) that assist with the preparation, making and/or finishing of the sewn product.

The local interface 118 of the robotic system 102 can be, for example, but not limited to, one or more buses or other wired or wireless connections, as is known in the art. The local interface 118 can have additional elements, which are omitted for simplicity, such as controllers, buffers (caches), drivers, repeaters, and receivers, to enable communications. Further, the local interface 118 can include address, control, and/or data connections to enable appropriate communications among the components, at element 122.

The sensing device(s) 120 of the robotic system 102 can facilitate detecting the position or movement of the product material(s) and inspecting the product material(s) for defects and/or discrepancies before, during or after a sewing or cutting operation or other process operation. Further, the sensing device(s) 120 can facilitate detecting markings on the product before cutting or sewing the material. A sensing device 120 can comprise, but is not limited to, one or more sensor and/or vision device/camera 126 such as, e.g., an RGB camera, an RGB-D camera, a near infrared (NIR) camera, stereoscopic camera, photometric stereo camera (single camera with multiple illumination options), time of flight camera, Internet protocol (IP) camera, light-field camera, monorail camera, multiplane camera, rapatronic camera, stereo camera, still camera, thermal imaging camera, acoustic camera, rangefinder camera, etc., at element 120. The RGB-D camera is a digital camera that can provide color (RGB) and depth information for pixels in an image. The sensing device(s) 120 can also include one or more motion sensor(s), temperature sensor(s), humidity sensor(s), microphone(s), ultrasound device(s), radar or lidar device(s), RF receiver(s) and/or other environmental or electronic sensor(s). The sensing device(s) 120 can include an edge sensor or other feedback device such as, e.g., a laser or fiber optic sensor to locate the edge of the material being processed. The edge sensor or feedback device may provide data to determine appropriate adjustments needed to position the material on the correct processing path.

An automated sewing or bonding machine 122 is a sewing or bonding device or system that can include, e.g., a computerized sewing machine or a computerized bonding or joining apparatus (e.g., ultrasonic welding, thermal bonding, gluing or other bonding or joining technology). The automated sewing or bonding machine 122 can be configured to sew or otherwise bond or join (e.g., ultrasonic welding) a perimeter or other path on the material.

Material aligners 124 provide traction in one direction to control positioning of material in that direction, while concurrently allowing movement of the material in a perpendicular direction. The material aligner 124 can actively control the position of the material along an axis in the first direction. The material aligner 124 can also provide resistance to movement of the material perpendicular to that axis. For example, as the material is pulled into the sewing or bonding machine, the resistance can provide tension in the material. The material aligners 124 can also allow movement of the material in directions at other angles than perpendicular to the first direction of active control. For instance, the material may be fed to the sewing machine 122 at an angle that is not perpendicular to the material aligner 124. Examples of material aligners 124 include, e.g., omni-chain material aligners 130 and omni-belt material aligners 132. The omni-chain material aligner 130 comprises a circular roller chain extending between two or more sprockets. The rollers of the circular roller chain provide traction in a first direction and rolling contact in a second perpendicular direction. The sprockets can be driven by a motor (e.g., a stepper motor) to perform active steering control of the material. Rolling contact and controlled roller pressure against the material allows for feed control (e.g. tension control) in the second direction and active steering control in the first direction during sewing or bonding. The omni-belt material aligner 132 comprises a belt (e.g., an indexed belt, chain, etc.) with attached perpendicular rollers, which allow feed control perpendicular to the length of the belt and active motorized steering control of the material being fed into the system along the length of the belt, while controlling applied roller pressure. Direct spring displacement 134 can be used to manage or control of the pressure applied by the material aligner 124 (e.g., the omni-chain material aligner 130 or the omni-belt material aligner 132) onto the material to facilitate control of material feeding.

Material aligners 124 can also include, e.g., an omni-belt material aligner 132, in which displacement can be controlled in order to control the applied pressure of the omni-belt on the material via torsion of the belt due to belt tension. Each offset-belt roller can contribute to the pressure applied along the full contact length of the material. Displacement of the omni-belt material aligner 132 can be controlled in order to control the applied pressure of the omni-belt on the material via the tension in the chain. Each omni-belt roller can contribute to the pressure applied along the full contact length of the material.

As shown in FIG. 1, the robotic system 102 includes operational control(s) 128 which can control the robotic system 102, as will be discussed. The operational control(s) 128 can include one or more process modules that can be executed in order to control operation of various components of the robotic system 102 such as the automated sewing or bonding machine 122 and/or the material aligner(s) 124.

Functioning of the omni-chain material aligner 130 will now be discussed with reference to FIGS. 2A and 2B. One skilled in the art will appreciate that, for this and other processes and methods disclosed herein, the functions performed in the processes and methods may be implemented in differing order. Furthermore, the outlined steps and operations are provided as examples, and some of the steps and operations may be optional, combined into fewer steps and operations, or expanded into additional steps and operations without detracting from the essence of the disclosed embodiments.

Figure 2A:
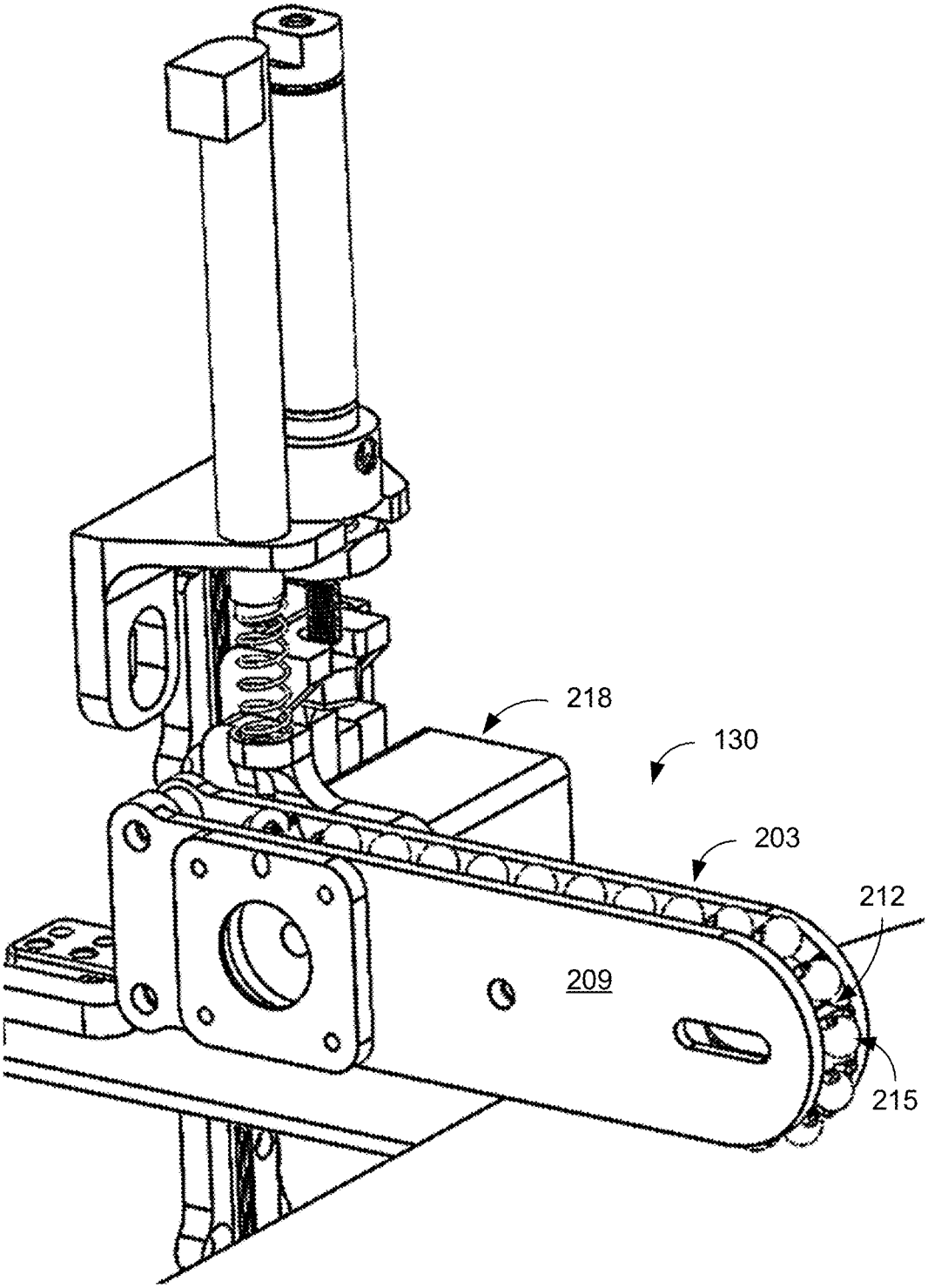
FIGS. 2A and 2B illustrate an example of an omni-chain material aligner, according to various embodiments of the present disclosure.
Figure 2B:
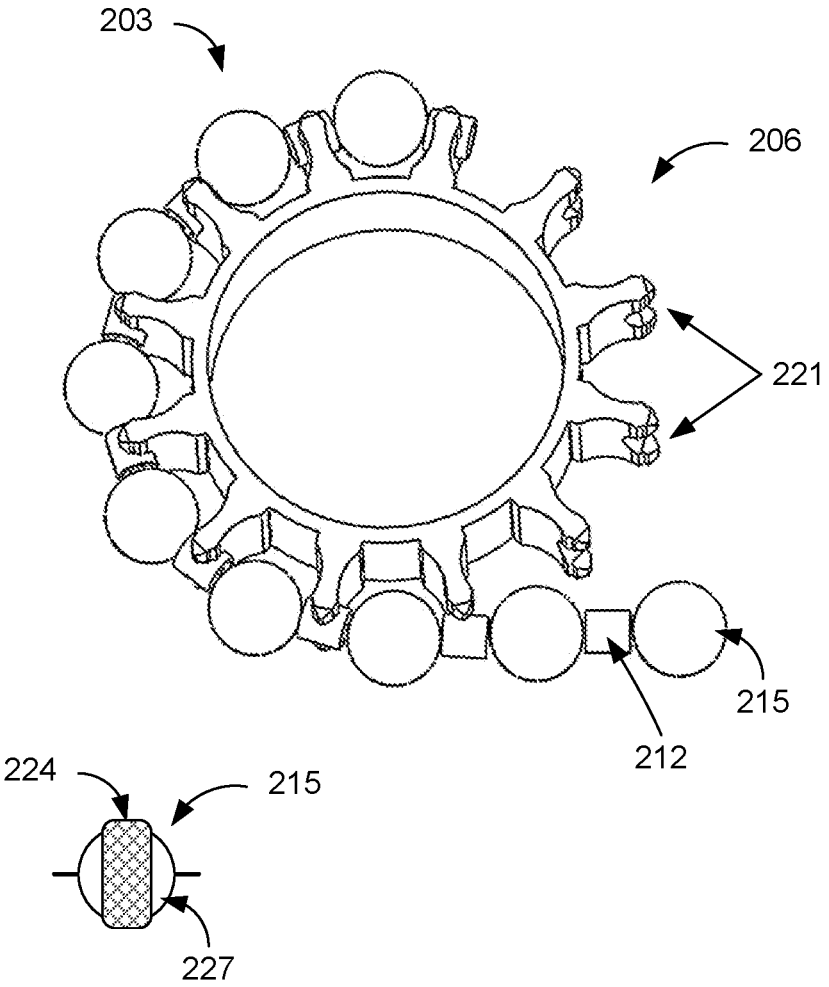

Referring to FIGS. 2A and 2B, shown is an example of an omni-chain material aligner 130, which includes a roller chain 203 extending between two sprockets 206 at opposite ends of a support arm 209. FIG. 2A displays an example of the omni-chain material aligner 130, which enables rolling contact and controlled roller pressure against the material to allow for feed control. The circular roller chain 203 can comprise a series of spacers 212 which are located between the rollers 215 in the chain 203. In some embodiments, the circular roller chain 203 can be free of spacers with a chain or linkage providing the separation between rollers 215. FIG. 2A shows an example of a portion of the roller chain 203 engaged with one of the sprockets 206. The sprockets 206 can include projections (or "teeth") 221 distributed about the circumference of the sprocket 206 and extending radially outward to engage with the chain 203.

In the example of FIG. 2B, a distal end of the projections 221 is shaped to cradle and support the spacers 212 by extending along opposite sides of the spacers 212. In some implementations, the projections can interface with the rollers 215 or the gap between the rollers 215 and the spacers 212. In other embodiments, the sprocket 206 can be configured with continuous sides forming a channel in which the circular roller chain 203 rests, similar to a traditional pulley. In some cases, the circular roller chain 203 can be guided at one end by a channel or track in the support arm 209 and engaged with a single sprocket 206, which can be driven by a motor 218.

The rollers 215 can have a shape that allows for rotation with respect to (or about) an axis extending through the roller 215. The rollers 215 are distributed along the length of the roller chain 203. For example, the rollers 215 can be spherical (as shown in FIGS. 2A and 2B), ovular, cylindrical, or other appropriate geometry that facilitates rotation about the rotational axis. The rollers 215 can be attached to a cable, belt, chain, strap, etc. along the length of the circular roller chain 203 such that the rotational axis is substantially parallel with the attachment point. This allows the rollers 215 to provide a contact force to be applied to a material in a first direction and tension to be applied in a second perpendicular direction in a controlled manner through the movements of the circular roller chain 203.

In some embodiments, the rollers 215 may be free spinning to not interfere or impede with a material moving parallel to the roller's rotation or provide a resistance to rotation in the direction of sewing (e.g., perpendicular to the rotational axis of the rollers 215 of the circular roller chain 203 on the sprockets 206). Within the rollers 215 of the circular roller chain 203 and the spacers 212 can be a flexible cable running therethrough. In some embodiments, the flexible cable may be omitted, and the spacers 212 and rollers 215 may be interconnected in another manner such as being coupled together by various joints. For example, the spacers 212 can be flexibly connected with the adjacent rollers 215 by pins that allow the roller chain 203 to rotate about the sprockets 206.

The rollers 215 in the circular roller chain 203 can be textured (e.g., comprising grooves, bumps, indents, etc.), or coated or wrapped with a coating or layer, to provide friction with the material. In some embodiments, the rollers 215 can comprise a low friction core (e.g., stainless steel) with a layer or coating (which can be textured or have other gripping properties) disposed on the roller surface that enhances the friction of the rollers 215. The coating or layer can be formed in a band around the roller 215 to improve contact with the material as the roller rotates about the rotational axis. The coating or layer can have a ribbed or toothed profile to enhance contact. In some embodiments, the rollers 215 can comprise a hub or bearing with a contact element (e.g., a rubber tire or other contact material) secured around the hub. FIG. 2B illustrates an example of a spherical roller 215 including a contact element 224 surrounding a hub 227.

The sprockets 206 are connected at relative positions on the support arm 209 in order to support and provide a guide for the circular roller chain 203 to extend along the first direction while allowing the rollers 215 connected to the sprockets 206 to freely spin. The distal end of the projections of the sprockets 206 can include a recess that can mesh with the spacers 212 to hold the circular roller chain 203 in alignment on the sprocket 206, while allowing the rollers 215 to still rotate when engaged. At least one sprocket 206 is driven by a motor 218 to perform active steering control, which may be used for edge alignment during an automated sewing process. In some embodiments, additional end effectors may be used in order to move the material through the omni-chain material aligner 130 in a motion perpendicular to the roller chain 203 while allowing the omni-chain material aligner 130 to provide the direction (either left or right) for the material.

Functioning of the omni-belt material aligner 132 will now be discussed with reference to FIG. 3A. One skilled in the art will appreciate that, for this and other processes and methods disclosed herein, the functions performed in the processes and methods may be implemented in differing order. Furthermore, the outlined steps and operations are provided as examples, and some of the steps and operations may be optional, combined into fewer steps and operations, or expanded into additional steps and operations without detracting from the essence of the disclosed embodiments.

Figure 3A:
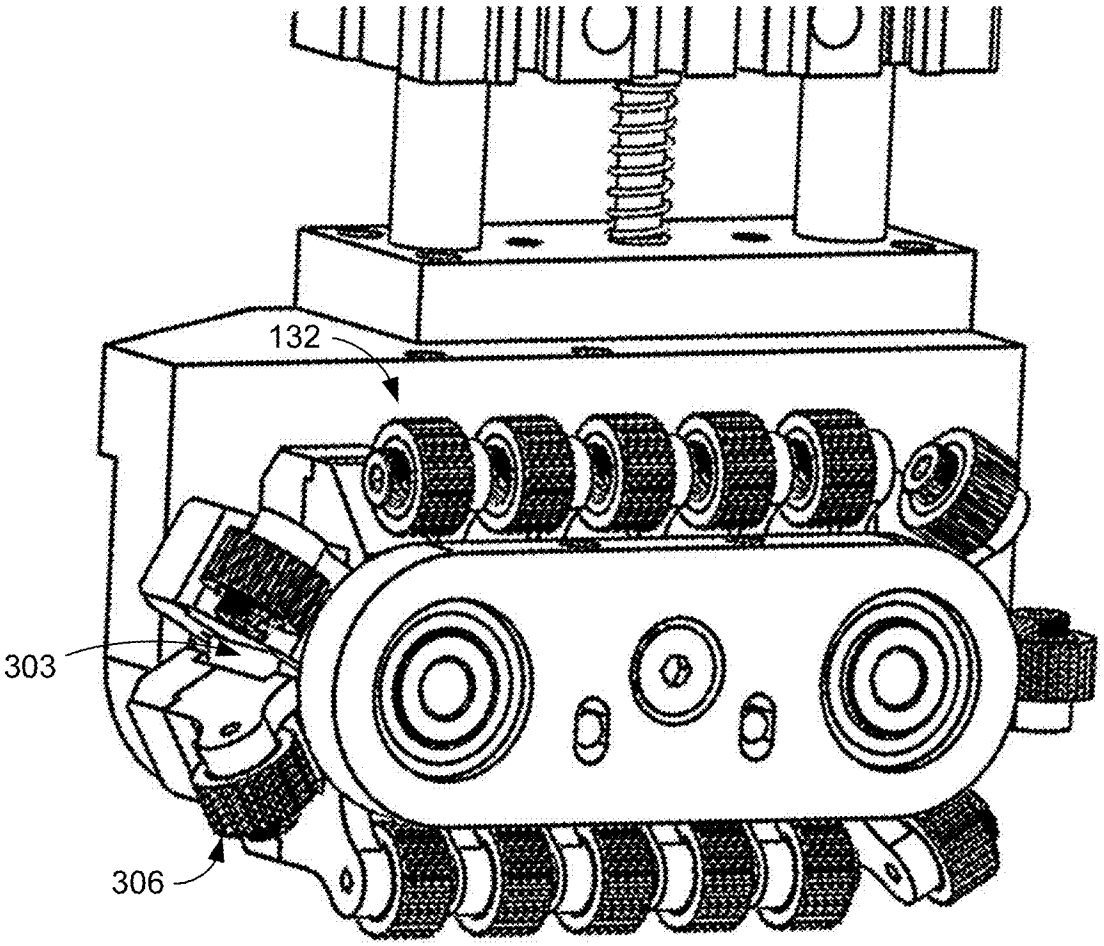
FIG. 3A-3C illustrate examples of omni-belt material aligners, according to various embodiments of the present disclosure.

FIG. 3A shows an example of an omni-belt material aligner 132. The omni-belt material aligner 132 comprises a belt 303 with attached perpendicular rollers 306 which allow feed control and active motorized steering control of the material being fed into the system, while controlling applied roller pressure. In some embodiments, the belt 303 may be one of a plurality of types of belts such as, e.g., a timing belt, indexed belt, round belt, or flat belt. The belt 303 may also be a plurality of belts, or some combination of types of belts with the rollers in-between or outside the belts. In some embodiments, the belt may be replaced with one or more types of chains, such as linked member chains, bike chains, etc. or some combination of different types of chains.

Functioning of the omni-belt material aligner 132 will now be discussed with reference to FIGS. 3B and 3C. One skilled in the art will appreciate that, for this and other processes and methods disclosed herein, the functions performed in the processes and methods may be implemented in differing order. Furthermore, the outlined steps and operations are provided as examples, and some of the steps and operations may be optional, combined into fewer steps and operations, or expanded into additional steps and operations without detracting from the essence of the disclosed embodiments.

Figure 3B:
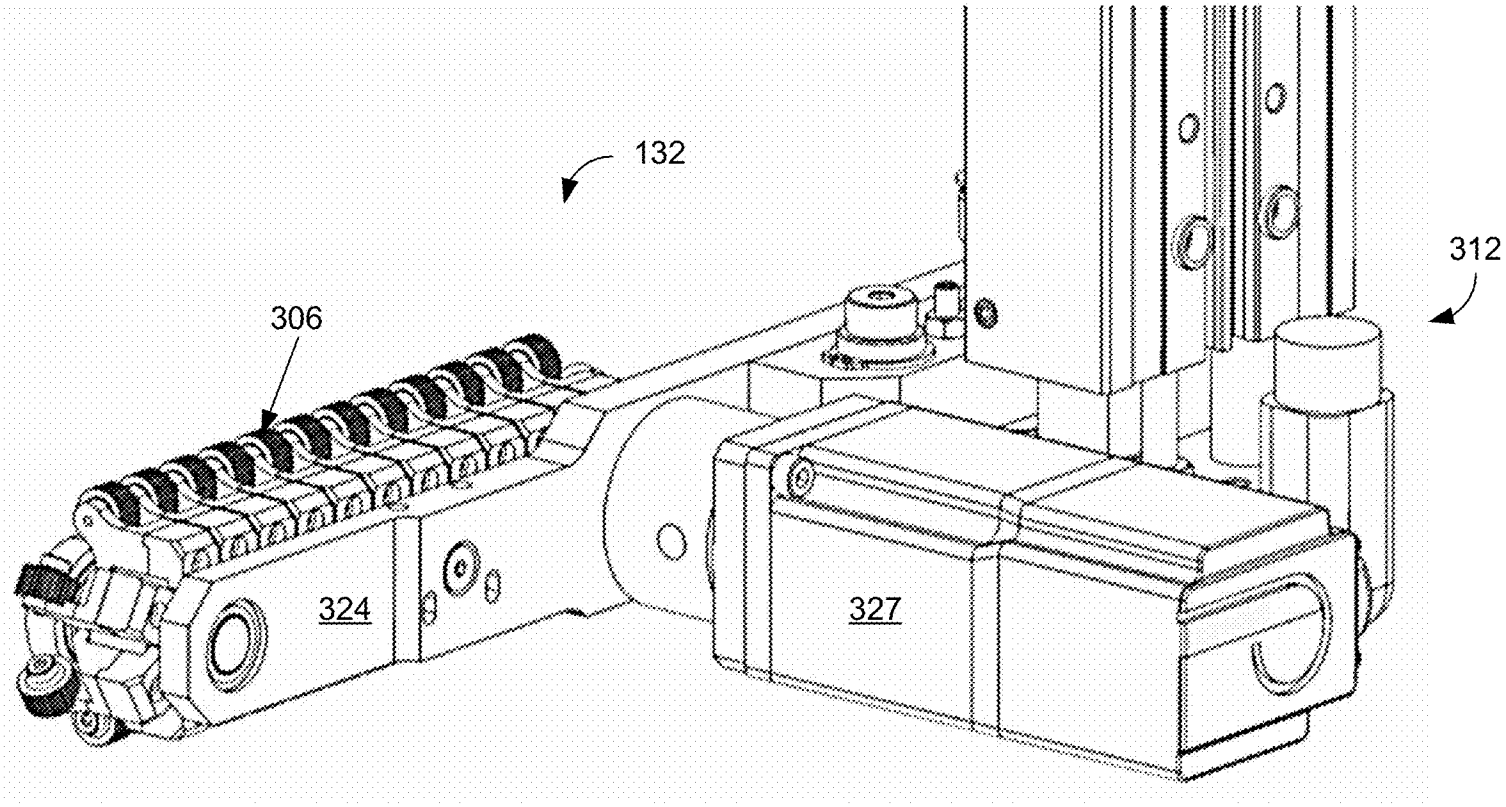
Figure 3C:
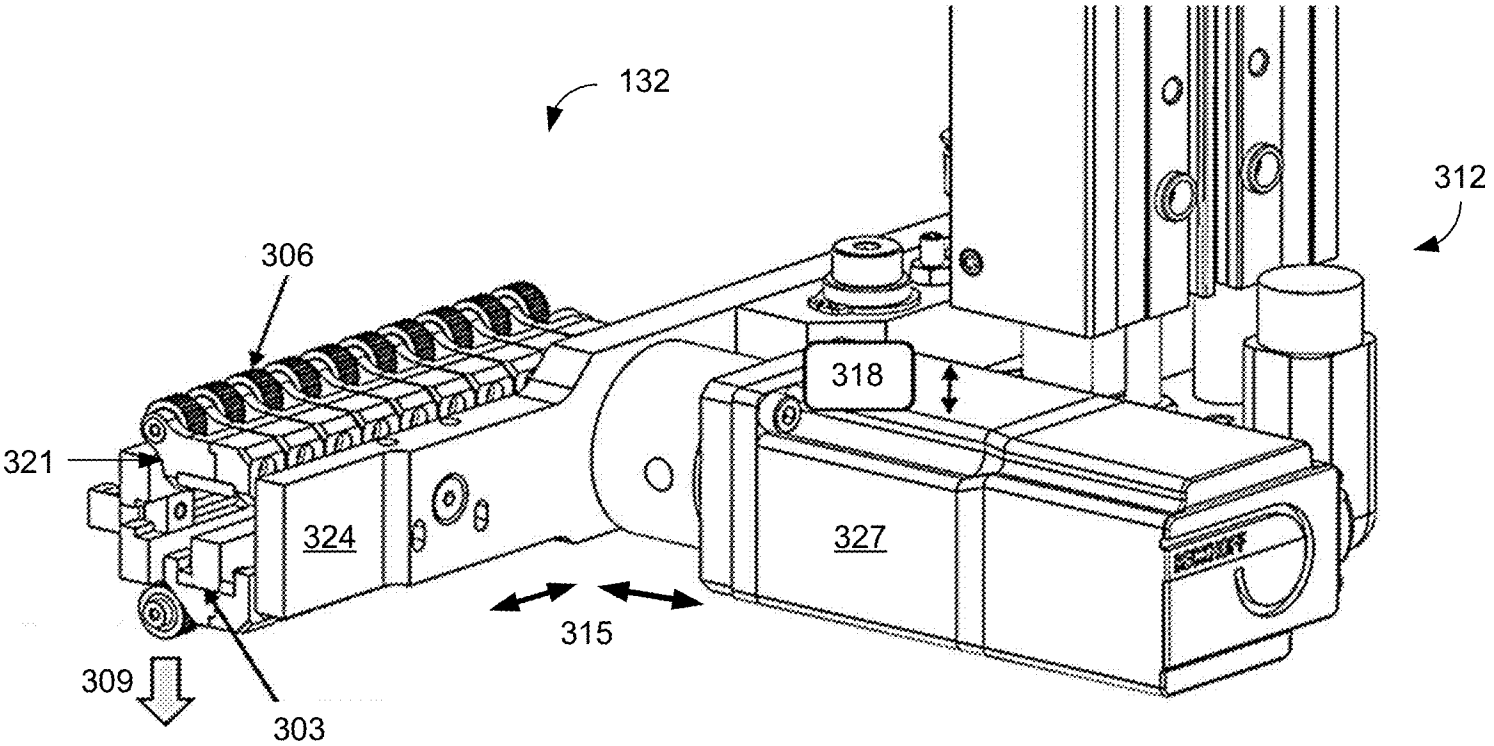

FIGS. 3B and 3C illustrate an example of the omni-belt material aligner 132, which includes a belt 303 (e.g., a timing belt, flat belt, etc.) and a series of rollers 306 affixed to the belt 303 in an offset fashion along one side of the belt 303. Force (arrow 309 of FIG. 3C) can be applied to the material by the omni-belt material aligner 132 through the rollers 306. Positioning the omni-belt material aligner 132 to press the rollers 306 against the material causes the belt 303 to twist, which acts as a spring to maintain the force on the material. Increasing the belt tension can increase the force produced by the twisting of the belt 303. In some embodiments, each roller 306 can be spring or mass loaded individually or in groups to press against the material. In other embodiments, the rollers 306 can be affixed in a position over (or vertically offset from) the belt 303 such that pressure on a roller 306 does not impart a twist on the belt 303.

Figure 4:
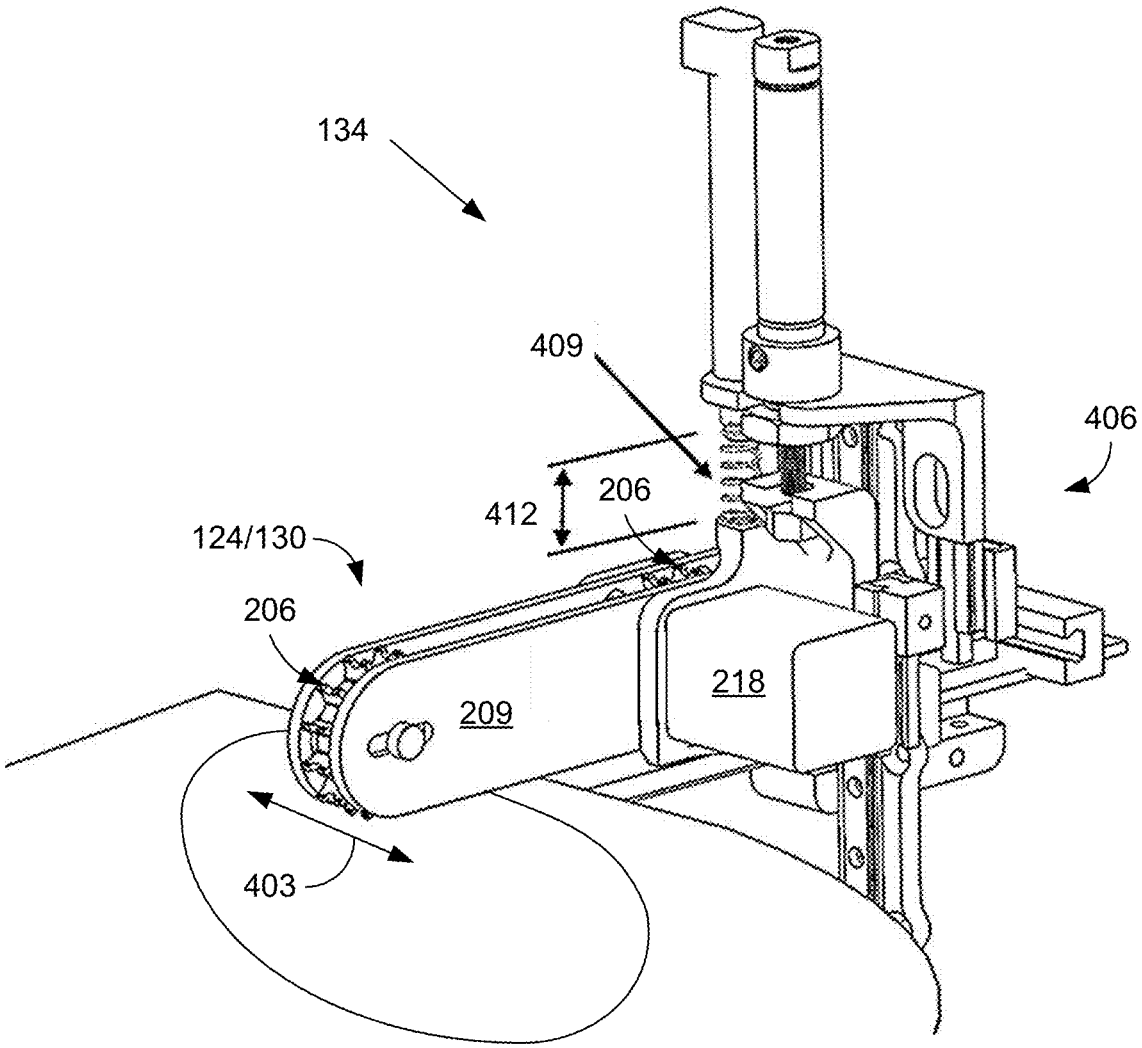
FIG. 4 illustrates an example of a direct spring displacement assembly, according to various embodiments of the present disclosure.

Support and positioning of the omni-belt material aligner 132 can be provided by, e.g., the translation system 312 shown in FIGS. 3B and 3C or the translation system 406 shown in FIG. 4. The translation system 312 can control up and down movement of the omni-belt material aligner 132 in in the Z direction (arrow 318) and, in some implementations, planar movement in the XY directions (arrows 315) as illustrated. The amount of pressure applied to the material can be controlled by the force applied to the rollers 306, which are offset from the belt 303, causing the belt 303 to twist.

FIG. 3C includes a cross-sectional view of an end of the omni-belt material aligner 132. The rollers 306 can be linked together on the belt 303 in order to provide rolling contact and control of the material. As shown, the series of rollers 306 can be connected to the belt 303 through, e.g., support frames or links 321 that can be detachably attached to the belt 303. The rollers 306 are free to spin in one direction (e.g., perpendicular to the axial length of the support arm 324) and are constrained in the direction along the axial length of the support arm 324. Each roller 306 contributes pressure along the contact length of the material, which is accomplished via torsion of the belt 303 as previously described. The belt 303 can be a timing belt that includes teeth that can engage with a sprocket or gear driven by a motor 327 for active steering and control of the material.

Contact pressure can be applied to the material via the rollers through a variety of methods. For example, active control such as, e.g., pneumatic or electrical position control and passive control such as, e.g., direct spring displacement can be implemented to adjust or maintain the contact pressure to the material. Functioning of direct spring displacement will now be discussed with reference to FIG. 4. One skilled in the art will appreciate that, for this and other processes and methods disclosed herein, the functions performed in the processes and methods may be implemented in differing order. Furthermore, the outlined steps and operations are provided as examples, and some of the steps and operations may be optional, combined into fewer steps and operations, or expanded into additional steps and operations without detracting from the essence of the disclosed embodiments.

FIG. 4 illustrates an example of a direct spring displacement assembly 134 that can be used for controlling the force applied to the material through the material aligner 124 with direct spring displacement 134. In the example of FIG. 4, an omni-chain material aligner 130 (without the circular roller chain 203) is shown for illustration. Control of the force applied by the material aligner 124 onto the material affects the contact that the material experiences. The amount of contact pressure that the material experiences can affect the tension of the material as it is pulled by the sewing machine perpendicularly to the material aligner 124 (see arrow 403).

As illustrated in FIG. 4, the assembly can include a translation system 406 that can support and position the material aligner 124. The translation system 406 shown in FIG. 4 can produce XYZ motion in which the XY motion is planar motion and the Z motion is up and down motion. The translation system can be controlled (e.g., through pistons, cylinders, linear motors, etc.) to position the material aligner 124 on the material for processing. The material aligner 124 can be pressed against the material with the aid of a spring 409, which may be set or controlled to apply a desired force onto the material being controlled. This embodiment would have the advantage of being independent from material height since the force is no longer depended on the displacement 412 of the spring 409. The force applied by the spring 409 may be adjusted using, e.g., a screw-type linear motor which can vary compression of the spring 409 against the material aligner 124. In some embodiments, a powered device such as, e.g., a pneumatic piston, electric solenoid or other appropriate mechanism to apply a controlled force which may be used as a substitute for the spring 409 to press the material aligner 124 down on the material.

Functioning of the chain tension displacement for a material aligner 124 will now be discussed with reference to FIG. 5. One skilled in the art will appreciate that, for this and other processes and methods disclosed herein, the functions performed in the processes and methods may be implemented in differing order. Furthermore, the outlined steps and operations are provided as examples, and some of the steps and operations may be optional, combined into fewer steps and operations, or expanded into additional steps and operations without detracting from the essence of the disclosed embodiments.

Figure 5:
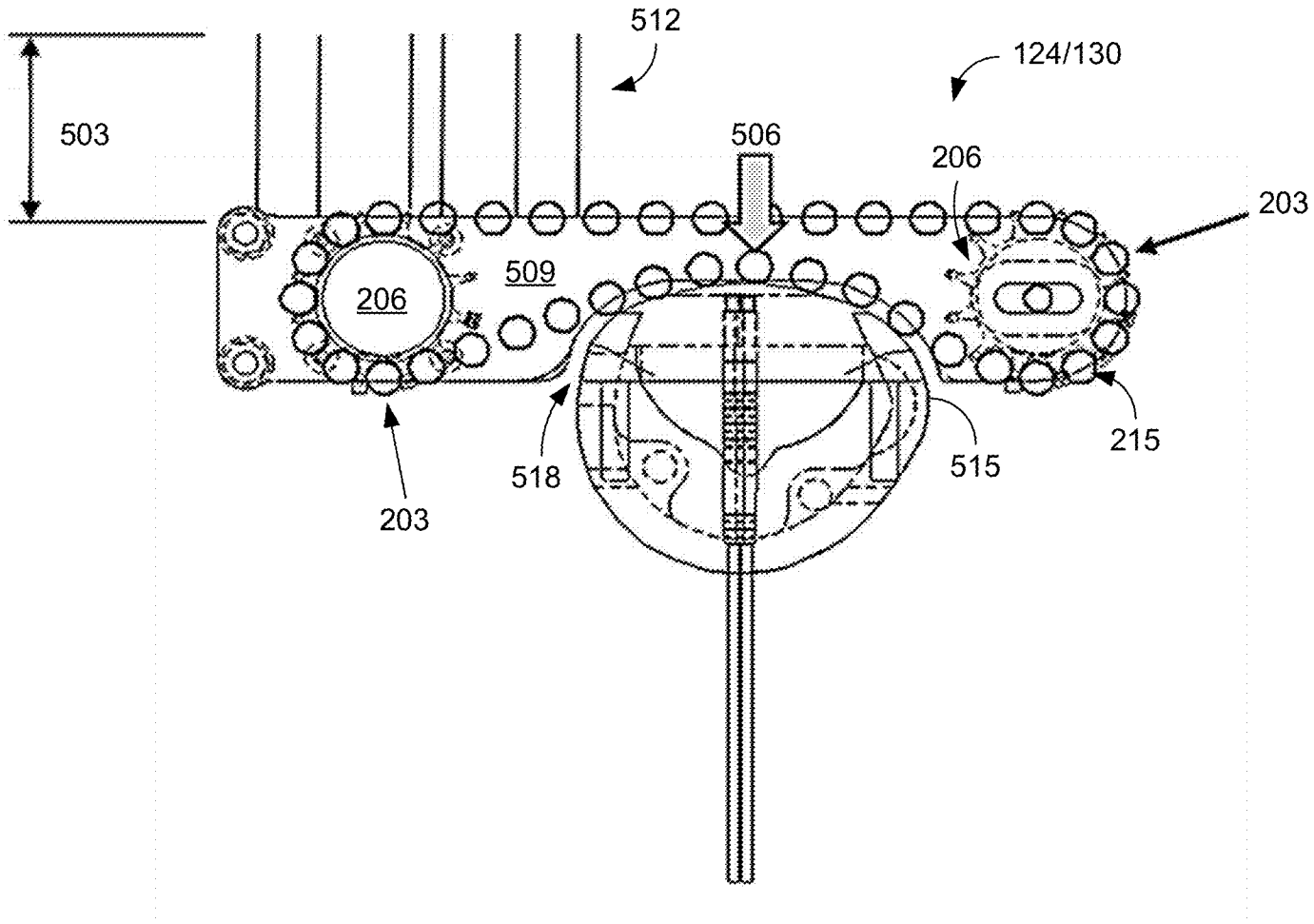
FIG. 5 illustrates an example of an omni-chain material aligner with chain displacement, according to various embodiments of the present disclosure.

FIG. 5 is a cross-sectional view illustrating an example of chain displacement in a material aligner 124 (e.g., an omni-chain material aligner 130) to account for shape variations. In the embodiment of FIG. 5, the omni-chain material aligner 130 comprises a circular roller chain 203 extending between two sprockets 206 mounted to a support arm 609. The rollers 215 of the circular roller chain 203 provide traction in one direction in line with the circular roller chain 203 and rolling contact in a perpendicular direction. The sprockets 206 can be driven by a motor to perform active steering control of the material. The support arm 609 can be shaped with a curved recess 518 along the lower edge to allow the roller chain 203 extending across the opening of the recess to flex upward. For example, the work surface 621 can be a curved surface that aids in the sewing a seam by the automated sewing or bonding machine 122. With the material positioned on the curved work surface 621, the circular roller chain 203 can be pressed onto the material to provide the active steering control. Each roller 215 on the chain 203 contributes pressure along the contact length of the material.

Support and positioning of the omni-chain material aligner 130 can be provided by, e.g., a translation system 612 that can produce Z motion, planar XY motion, or a combination of both. Vertical displacement (Z motion) of the material aligner is represented by arrow 603. The circular roller chain 203 can be positioned on the material by lowering the omni-chain material aligner 130 onto the material on the curved work surface 615. As the omni-chain material aligner 130 is lowered, the pressure (arrow 606) applied to the material by the circular roller chain 203 can vary as the position of the material aligner is changed. The embodiment of FIG. 5 provides additional flexibility of the chain to provide the ability to control material over curved or flexed surfaces. The slack in the chain can be adjusted to provide the appropriate flexibility for a curved surface and provide control of a material over a flat surface. In some implementations, the chain slack can be controlled by varying the distance between the sprockets 206 by repositioning one or more of the sprockets 206.

Operation of a material aligner 124 will now be discussed with reference to FIG. 6. One skilled in the art will appreciate that, for this and other processes and methods disclosed herein, the functions performed in the processes and methods may be implemented in differing order. Furthermore, the outlined steps and operations are provided as examples, and some of the steps and operations may be optional, combined into fewer steps and operations, or expanded into additional steps and operations without detracting from the essence of the disclosed embodiments.

Figure 6:
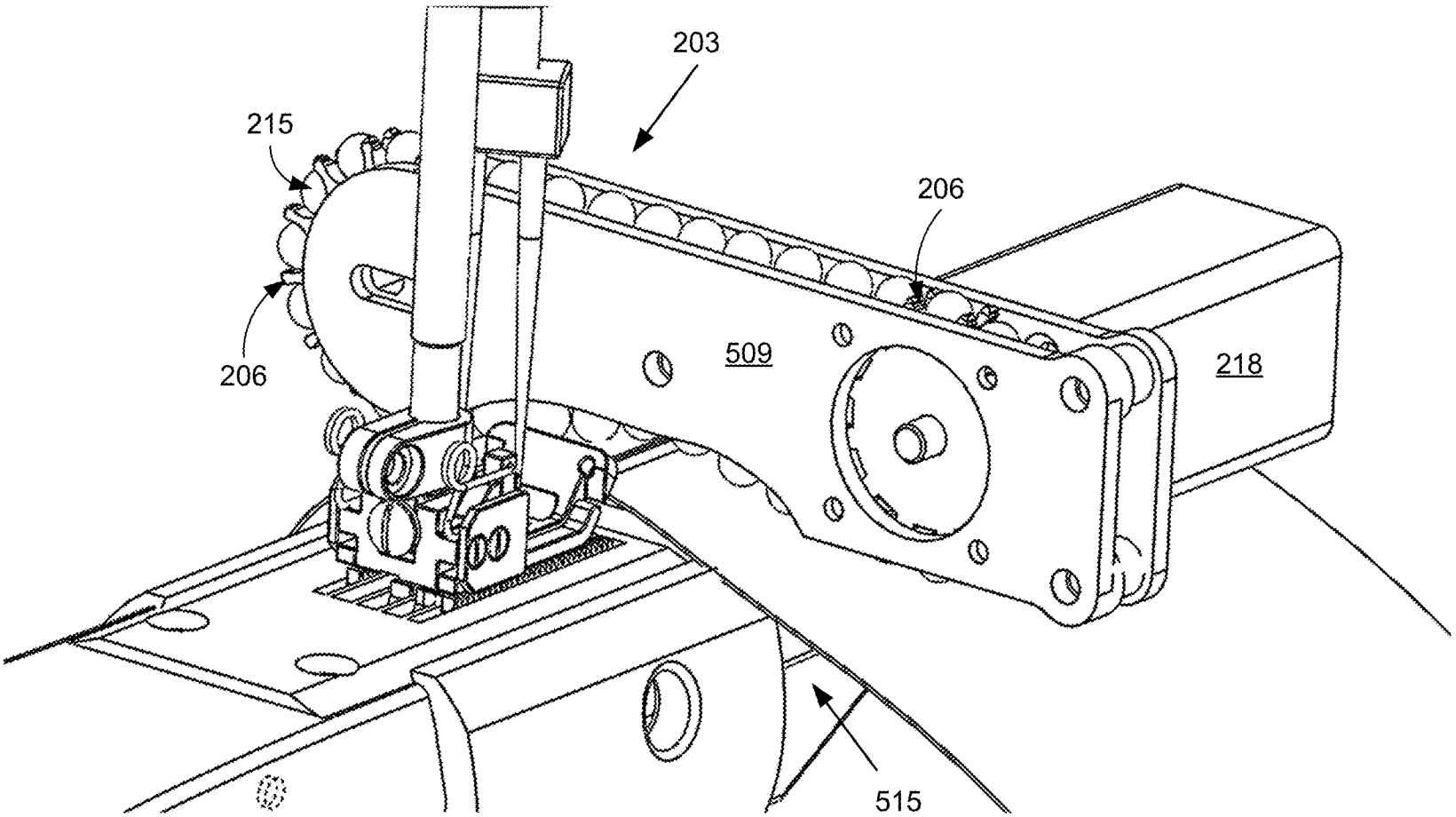
FIG. 6 illustrates an example of an omni-chain material aligner following a seam, according to various embodiments of the present disclosure.

FIG. 6 shows an example of the omni-chain material aligner 130 of FIG. 5 following a seam that is being fed into a sewing machine 122. While this example discusses operation of the omni-chain material aligner 130, it is also applicable to the omni-belt material aligner 132. As the seam is sewn by the sewing needle, the material can be pulled through the sewing machine 122 by a feed mechanism. In some embodiments, movement of the material through the sewing machine 122 may be provided by an end effector, actuator, or by some other material mover 114. With the material laying on the work surface 515 (curved or otherwise), the circular roller chain 203 can be positioned on the material to provide a desired force against the material. Contact pressure can be applied to the material via the rollers 215.

Movement of the circular roller chain 203 on the sprockets 206 can reposition the material on the work surface during the sewing process. By rotating the circular roller chain, the material can be made to change its angle with respect to the sewing machine feed direction and or shift along the first direction extending along the material aligner 124. Shifting the material side-to-side can change the angle that the material is supplied to the sewing needle, which allows the seam to be sewn along a curved or nonlinear path. Adjustment of the material position can be based upon a tracking feature (e.g., the seam or other optically or mechanically detectable feature of the material) that can be detected by the sensing device(s) 120 of the robotic system 102 (FIG. 1). One or more material aligners 124 can be utilized to facilitate following the tracking feature as it is related to stitching or adhering another material to the surface of the material(s). For example, for materials already joined together with a seam, laying open and flat on the work surface 515 (with the seam facing the surface 515 or facing away from the surface 515), the sewing path can be controlled by tracking the seam in the material.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

The term "substantially" is meant to permit deviations from the descriptive term that don't negatively impact the intended purpose. Descriptive terms are implicitly understood to be modified by the word substantially, even if the term is not explicitly modified by the word substantially.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include traditional rounding according to significant figures of numerical values. In addition, the phrase "about 'x' to 'y'" includes "about 'x' to about 'y'".

Therefore, at least the following is claimed:

1. An apparatus for controlling the motion of materials in at least two directions, comprising;

a material contact loop comprising rollers distributed about a length of the material contact loop, the rollers configured to rotate about a rotational axis substantially parallel to the material contact loop;

a support arm comprising a plurality of loop guides, the material contact loop positioned over the plurality of loop guides, wherein the support arm comprises a recess extending inward from an edge of the support arm, and the material contact loop extends across an opening of the recess; and a loop driver coupled to at least one loop guide of the plurality of loop guides, the loop driver configured to control rotation of the material contact loop about the plurality of loop guides and along a length of the support arm, while allowing rotation of the rollers about the material contact loop.

2. The apparatus of claim 1, wherein the material contact loop is a circular roller chain, and the rollers comprise rollers separated by spacers about the length of the circular roller chain.

3. The apparatus of claim 2, wherein the rollers and spacers are secured in series to form the circular roller chain.

4. The apparatus of claim 3, wherein the rollers and spacers are secured by a cable extending through the rotational axis of the rollers and through the spacers.

5. The apparatus of claim 2, wherein the rollers are spherically shaped.

6. The apparatus of claim 2, wherein the plurality of loop guides comprise sprockets configured to engage the circular roller chain.

7. The apparatus of claim 6, wherein the sprockets comprise projections configured to engage with the circular roller chain between the rollers and adjacent to the spacers.

8. An apparatus for controlling the motion of materials in at least two directions, comprising;

a material contact loop comprising rollers distributed about a length of the material contact loop, the rollers configured to rotate about a rotational axis substantially parallel to the material contact loop, wherein the material contact loop is a belt, where the rollers are offset from and secured to the belt by a support structure;

a support arm comprising a plurality of loop guides, the material contact loop positioned over the plurality of loop guides; and a loop driver coupled to at least one loop guide of the plurality of loop guides, the loop driver configured to control rotation of the material contact loop about the plurality of loop guides and along a length of the support arm, while allowing rotation of the rollers about the material contact loop.

9. The apparatus of claim 8, wherein an outer surface of the rollers is textured.

10. The apparatus of claim 8, wherein the support structure is detachably attached to the belt.

11. The apparatus of claim 8, wherein a coating or contact layer is disposed on an outer surface of the rollers.

12. A system for transporting and sewing material, comprising:

a sewing machine including a sewing needle;

a material aligner configured to engage material on a work surface for sewing by the sewing machine, the material aligner comprising:

a material contact loop comprising rollers distributed about a length of the material contact loop, where the material contact loop is a belt with the rollers offset from and secured to the belt by a support structure;

a support arm comprising a plurality of loop guides, the material contact loop positioned over the plurality of loop guides; and;

a loop driver coupled to at least one loop guide of the plurality of loop guides, the loop driver configured to control rotation of the material contact loop about the plurality of loop guides and along a length of the support arm; and a translation system configured to position the material aligner on the material, where rotation of the material contact loop repositions the material on the work surface along the length of the support arm, and the rollers allow free movement of the material perpendicular to the length of the support arm.

13. The system of claim 12, wherein the rollers comprise a contact element surrounding a hub.

14. The system of claim 13, wherein the contact element comprises a textured surface.

15. The system of claim 12, wherein the support structure is detachably attached to the belt.

16. A system for transporting and sewing material, comprising:

a sewing machine including a sewing needle;

a material aligner configured to engage material on a work surface for sewing by the sewing machine, the material aligner comprising:

a material contact loop comprising rollers distributed about a length of the material contact loop;

a support arm comprising a plurality of loop guides, the material contact loop positioned over the plurality of loop guides;

a loop driver coupled to at least one loop guide of the plurality of loop guides, the loop driver configured to control rotation of the material contact loop about the plurality of loop guides and along a length of the support arm; and a translation system configured to position the material aligner on the material, where rotation of the material contact loop repositions the material on the work surface along the length of the support arm, and the rollers allow free movement of the material perpendicular to the length of the support arm, wherein the translation system comprises a spring configured to provide direct spring displacement of the material aligner when positioned on the material.

17. The system of claim 16, wherein the material contact loop is a circular roller chain, and the rollers comprise rollers separated by spacers about the length of the circular roller chain.

18. The system of claim 17, wherein the rollers apply pressure to the material based on the position of the material aligner.

19. A system for transporting and sewing material, comprising:

a sewing machine including a sewing needle;

a material aligner configured to engage material on a work surface for sewing by the sewing machine, the material aligner comprising:

a material contact loop comprising rollers distributed about a length of the material contact loop, where the material contact loop is a circular roller chain, and the rollers comprise rollers separated by spacers about the length of the circular roller chain;

a support arm comprising a plurality of loop guides, the material contact loop positioned over the plurality of loop guides, wherein the support arm comprises a recess extending inward from an edge of the support arm, and the circular roller chain extends across an opening of the recess;

a loop driver coupled to at least one loop guide of the plurality of loop guides, the loop driver configured to control rotation of the material contact loop about the plurality of loop guides and along a length of the support arm; and a translation system configured to position the material aligner on the material, where the rollers apply pressure to the material based on the position of the material aligner, and rotation of the material contact loop repositions the material on the work surface along the length of the support arm, and the rollers allow free movement of the material perpendicular to the length of the support arm.

20. The system of claim 19, wherein the plurality of loop guides comprise sprockets configured to engage spacers between the rollers of the circular roller chain.

* * * * *